US008152416B2

(12) United States Patent
Bureau

(10) Patent No.: US 8,152,416 B2
(45) Date of Patent: Apr. 10, 2012

(54) DEVICE FOR EXPANDING AND/OR EVACUATING PARTS OF ANCHORS

(75) Inventor: Mario Bureau, Quebec (CA)

(73) Assignee: Atlas Copco MAI GmbH, Feistritz an der Drau (AT)

( * ) Notice: Subject to any disclaimer, the term of this patent is extended or adjusted under 35 U.S.C. 154(b) by 347 days.

(21) Appl. No.: 11/919,644

(22) PCT Filed: Dec. 14, 2006

(86) PCT No.: PCT/AT2006/000516
§ 371 (c)(1),
(2), (4) Date: Jan. 31, 2009

(87) PCT Pub. No.: WO2007/082319
PCT Pub. Date: Jul. 26, 2007

(65) Prior Publication Data

US 2010/0074695 A1 Mar. 25, 2010

(30) Foreign Application Priority Data

Jan. 19, 2006 (AT) ..... A 87/2006

(51) Int. Cl.
*E21D 20/00* (2006.01)

(52) U.S. Cl. ..... 405/259.3; 405/259.1

(58) Field of Classification Search ..... 405/259.1, 405/259.3
See application file for complete search history.

(56) References Cited

U.S. PATENT DOCUMENTS 3,837,258 A 9/1974 Williams
4,423,986 A * 1/1984 Skogberg ..... 405/259.3
4,511,289 A * 4/1985 Herron ..... 405/259.3
(Continued)

FOREIGN PATENT DOCUMENTS

DE 27 49 068 A1 5/1979
(Continued)

OTHER PUBLICATIONS

Japanese Office Action, dated Nov. 16, 2010, in Application No. 550587/08.

*Primary Examiner* — Frederick L Lagman
(74) *Attorney, Agent, or Firm* — Young & Thompson

(57) ABSTRACT

After a rock anchor (1), in particular an expandable friction tube anchor (1), comprising an anchor bolt (2) has been inserted into a pre-sunk borehole with an end sleeve (4) first, an adapter (6) having a liquid inflow and outflow is arranged on a sleeve (3). On the one hand, a holding pressure which secures the adapter (6) to the sleeve (3) is produced via a holding-pressure line (8). On the other hand, fluid flows into the anchor bolt (2) via an expansion line (7) and starts to fill said bolt. In the process, the increase in pressure (inflation pressure) causes the anchor bolt (2) to expand in the borehole, with the result that its outer surface presses against the borehole wall and thus secures the rock anchor (1) in the borehole. A gas supply connected to the adapter (6) makes it possible for a gas under pressure, in particular compressed air, to be introduced into the anchor bolt (2) before and/or after the expansion thereof. The compressed gas is relieved following the removal of the adapter (6) (pressure equalization) and conveys the fluid contained in the anchor bolt (2) virtually completely from the anchor (1).

20 Claims, 3 Drawing Sheets

U.S. PATENT DOCUMENTS

| | | | | |
|---|---|---|---|---|
| 4,634,317 | A * | 1/1987 | Skogberg et al. | 405/259.3 |
| 4,635,333 | A | 1/1987 | Finch | |
| 4,696,606 | A * | 9/1987 | Herron | 405/259.3 |
| 4,954,017 | A * | 9/1990 | Davis et al. | 405/259.3 |
| 2005/0097849 | A1 * | 5/2005 | Hayes | 52/698 |
| 2007/0274788 | A1 * | 11/2007 | Ravat | 405/259.3 |
| 2009/0035071 | A1 * | 2/2009 | Tschernuth et al. | 405/259.3 |

FOREIGN PATENT DOCUMENTS

| | | | |
|---|---|---|---|
| EP | 0 016 742 | A1 | 10/1980 |
| JP | 09221975 | | 8/1997 |
| JP | 2006-219933 | | 8/2006 |
| WO | 2005/047650 | A1 | 5/2005 |
| WO | WO 2005118190 | A1 * | 12/2005 |

* cited by examiner

DEVICE FOR EXPANDING AND/OR EVACUATING PARTS OF ANCHORS

BACKGROUND OF THE INVENTION

The invention relates to a device for expanding and/or evacuating parts of anchors, especially rock anchors of the friction tube anchor type or expandable friction tube anchor type.

Furthermore the invention relates to a process for evacuating parts of anchors, especially of rock anchors of the friction tube anchor type or expandable friction tube anchor type.

Moreover the invention relates to a process for setting anchors, especially rock anchors of the friction tube anchor type or expandable friction tube anchor type.

DESCRIPTION OF THE RELATED ART

Anchors with expandable parts to be inserted into a bore hole are known for consolidating or securing rock and soil, for example in tunnel building or for securing slopes. These anchors, especially friction tube anchors or expandable friction tube anchors, are known as "Swellex" (manufacturer Atlas Copco MAI GmbH). As expandable parts these anchors have especially expandable anchor bolts with an outside surface in the expanded state adjoining the bore hole wall and thus fixing the anchor in the bore hole. The bolt can be expanded with water which is introduced with pressure into the anchor bolt by means of a pump via a removable adapter.

The air which has been compressed in the anchor bolt after the medium to be expanded, especially water, has been pressed in, causes the water to be pressed out of the anchor bolt again after removing the adapter. But it has been found to be disadvantageous for water to emerge uncontrolled and only partially again from the anchor bolt. A certain residual portion of water remains in the anchor bolt and together with the air contained in the anchor bolt promotes corrosion processes which adversely affect the service life of the anchor, especially a friction tube anchor.

SUMMARY OF THE INVENTION

The object of the invention is to make available a device and a process of the initially mentioned type with which the indicated disadvantages are avoided as much as possible.

This object is achieved with a device for expanding and/or evacuating parts of anchors, especially rock anchors.

Furthermore this object is achieved with a process for evacuating parts of anchors, especially of rock anchors.

Furthermore, this object is achieved with the process for setting an anchors, especially a rock anchor.

In anchors, especially in rock anchors made as expandable friction tube anchors, with expandable parts (anchors of the "Swellex" type) and an adapter which is removably located on the anchor and which is connected via at least one fluid line both to a pump and also to the expandable parts, the adapter is connected directly or indirectly to a gas supply. Thus, pressurized gas can be supplied to the expandable parts for evacuation after they have been expanded (widened) and are at least partially filled with fluid. The gas expands in the expanded parts and presses the fluid necessarily out of the anchor. This process can optionally be repeated until the fluid has been completely removed. The corrosion processes which take place by the interaction of air and water in the anchor bolt can thus be almost completely stopped, with which the service life of the anchor is significantly increased.

The pressurized gas, especially compressed air, can be introduced both before and also after the anchor is supplied with the expanding fluid. For an artificially produced overpressure before supply with fluid, in contrast to known methods in which only the air volume which is under normal air pressure in the anchor is compressed, as the effect much less residual water remains in the anchor after pressure equalization. The fluid introduced into the expandable parts can be almost completely withdrawn in a controlled manner after expanding and optionally can be re-used to expand parts of other anchors.

Other details, features and advantages of the device of the invention on the one hand and the process will become apparent from the following description with reference to the attached drawings, in which one preferred embodiment is shown.

DESCRIPTION OF THE PREFERRED EMBODIMENTS

Figure 1:
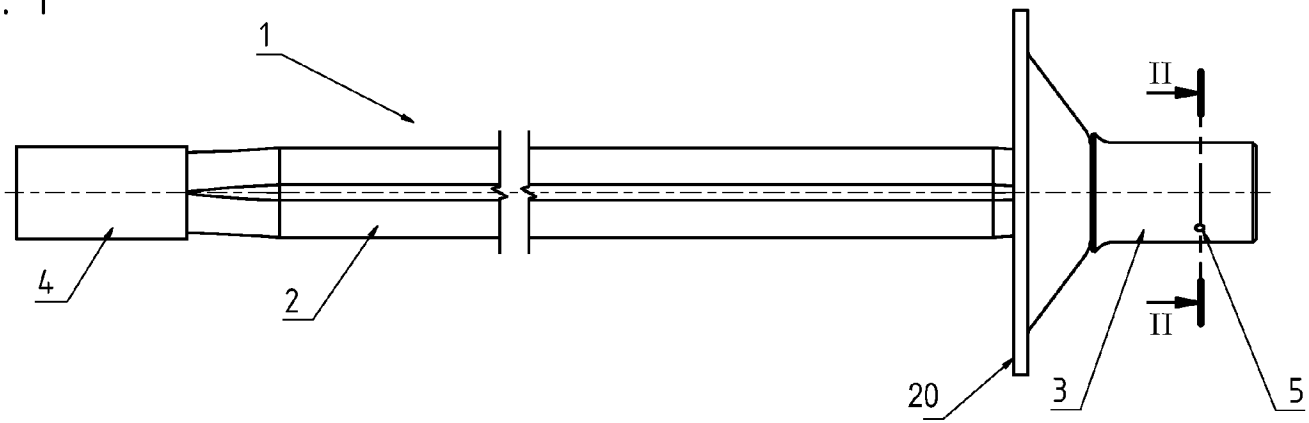
FIG. 1 shows a schematic lengthwise view of one embodiment of a rock anchor.

FIG. 1 shows a rock anchor 1 in which the device of the invention and the process of the invention can be used. The illustrated embodiment corresponds to a expandable friction tube anchor as is known for example from U.S. Pat. No. 4,459,067 A and is also called "Swellex". The rock anchor 1 is designed to be inserted into a bore hole and fixed in it to consolidate or secure rock and soil.

Figure 2:
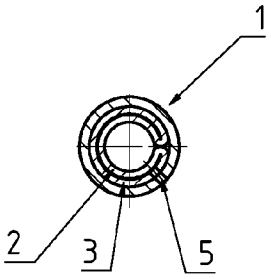
FIG. 2 shows a cross sectional view of the rock anchor from FIG. 1.

Essentially the rock anchor 1 encompasses a expandable part which on one end which is adjacent to the outer end of the bore hole (on the right in FIG. 1) has a sleeve 3 and on the other end is closed by an end sleeve 4. The expandable part can be especially an anchor bolt 2 which, as is apparent in FIG. 2, is formed by a tube folded to the inside in the lengthwise direction with an essentially omega-shaped profile. The anchor bolt 2 can be expanded by increasing the pressure within the folded tube so that the outer surface of the tube adjoins the bore hole wall and fixes the rock anchor 1 in the bore hole in this way.

In the sleeve 3 there is an opening, for example a hole 5, the function of which is described below.

Within the framework of the invention it is of course also possible that instead of the described friction tube anchor, other types and embodiments of anchors, preferably those of the initially mentioned type, can be used. One example is an embodiment which is known as "Swellex Hybrid" (manufactured by Atlas Copco MAI GmbH). This rock anchor is characterized in that several sections of rigid anchor rods/tubes are interconnected via coupling members and that on the (front) end of the anchor rod which has been formed in this way and which is inserted into the bore hole, there is simply a short segment of a expandable part like the anchor bolt 2 described above.

The rock anchor 1 can bear an anchor plate 20 on its end which is located on the opening of the bore hole and the anchor plate 20 is supported on the sleeve 3 on the soil or rock side.

Figure 3:
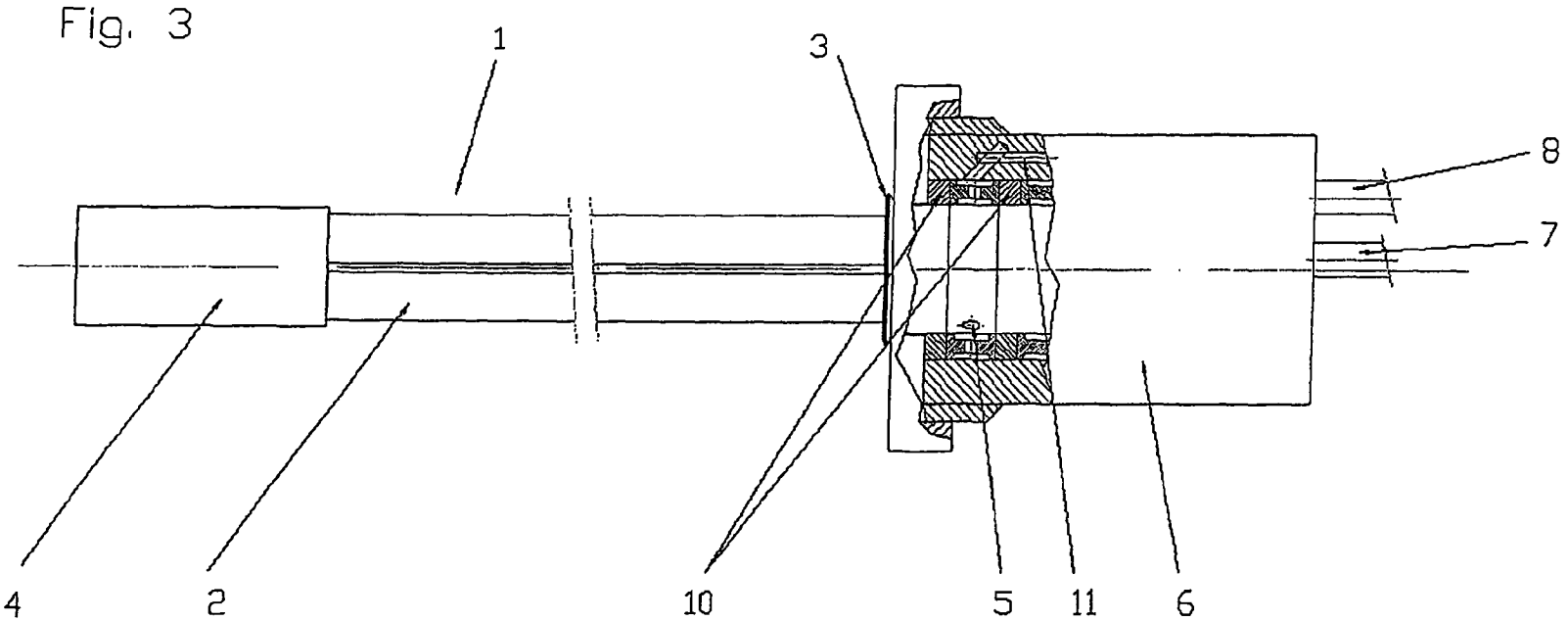
FIG. 3 the rock anchor from FIG. 1 with an attached adapter.

After the rock anchor 1 with attached anchor plate 20 has been inserted into the bore hole, there is an adapter 6 on the sleeve 3, as is apparent in FIG. 3. In one preferred embodiment, the adapter 6 as an inflation adapter is slipped or screwed onto the sleeve 3. The adapter 6 is connected to a pump 9 via a fluid line, especially an expansion line 7, and via a fluid line, especially a holding pressure line 8. To increase the pressure within the anchor bolt 2 the pump makes available a fluid working pressure (inflation pressure) of preferably 100 to 500 bar, especially 240 to 300 bar.

The fluid from the holding pressure line 8 within the adapter 6 presses two gaskets 10 together (holding pressure) such that the bulges of the gasket 10 which arise press against the sleeve 3 and tightly surround it securely against the inflation pressure. Then fluid flows from the expansion line 7 via a supply hole 11 to the hole 5 which is located in the sealed space between the two gaskets 10, enters the anchor bolt 2 and begins to fill it. In this connection, the omega profile of the anchor pin 2 is unfolded so that the outside surface of the anchor bolt 2 adjoins the bore hole wall and fixes the rock anchor 1 in the bore hole in this way. The anchor bolt profile attains a roughly round cross section with completed deployment at a fluid working pressure of roughly 240 to 300 bar.

Since the bore hole in practice has a smaller diameter than the completely expanded anchor bolt 2, it cannot completely deploy so that it presses against the bore hole wall while maintaining a lengthwise fold. The advantage of the lengthwise fold which has formed is that it increases stability by the resulting stiffening. By maintaining the working pressure over an interval of at least six seconds, the anchor bolt 2 is also pressed into irregularities of the bore hole wall and forms a frictional and positive connection.

Figure 4:
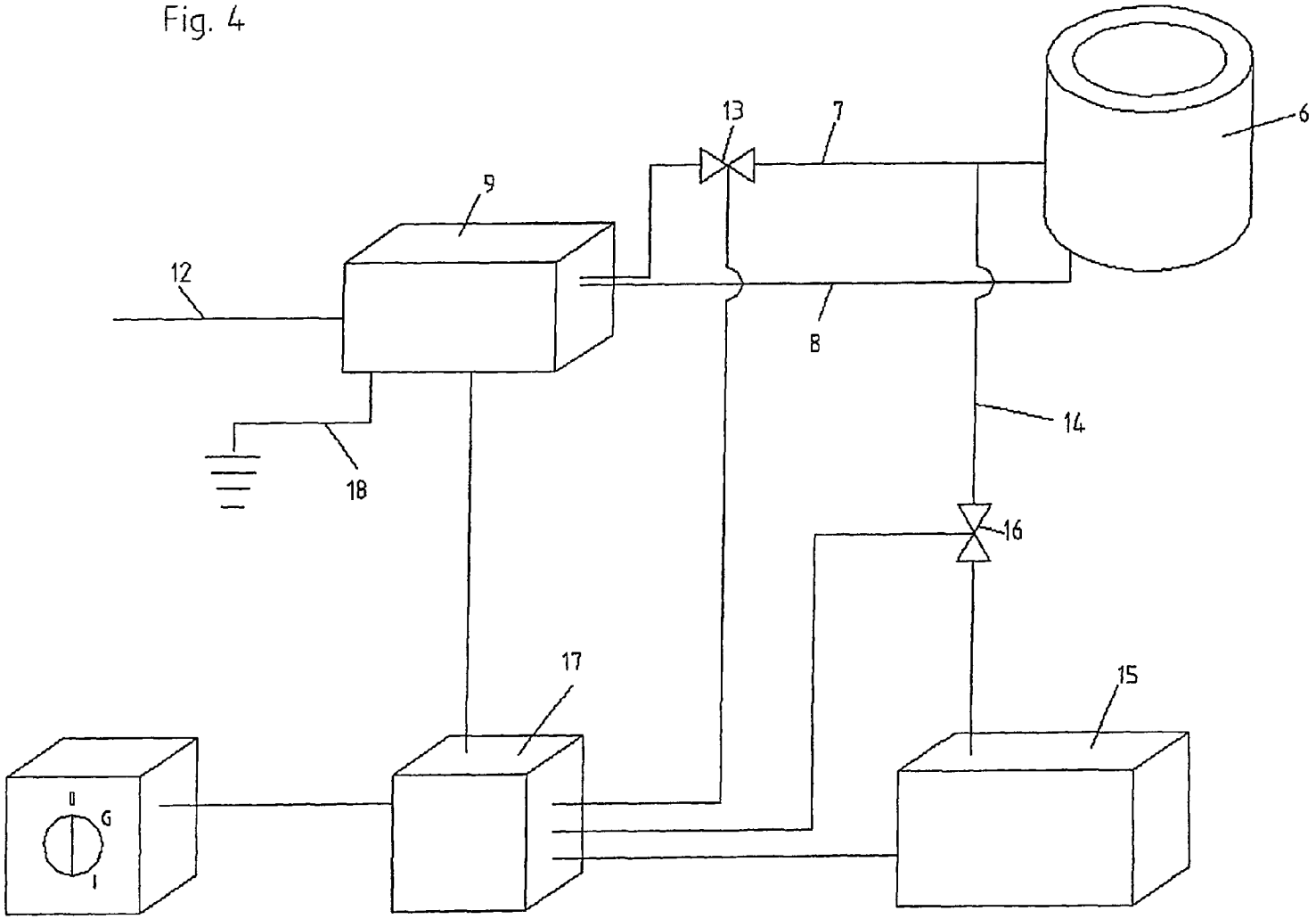
FIG. 4 shows one embodiment of the device of the invention for expanding and/or evacuating parts of the rock anchor in a schematic.

FIG. 4 shows how the adapter 6 is connected to the pump 9 via the expansion line 7 and the holding pressure line 8. The pump 9 is in turn connected to a fluid supply line 12. In the expansion line 7 there is a valve 13 via which the inflow and outflow of fluid into and out of the adapter 6 are controlled.

Moreover it is provided by the invention that the adapter 6 is connected to a gas supply which in the illustrated embodiment is formed by another fluid line, especially a gas line 14, and a compressor 15. The compressor 15 can be an air compressor or can be connected to a compressed air tank. In the illustrated embodiment, the gas line 14 discharges proceeding from the compressor 15, not directly into the adapter 6, but ends in the expansion line in the region between the adapter 6 and the valve 13. In the gas line 14 there is a valve 16 via which the passage of gas is regulated. The valves 13, 16 and the pump 9 and the compressor 15 are controlled via a control unit 17.

In the invention the described device acts as a system for recovery of the medium which expands the anchor bolt 2, especially as a water recovery system. By means of the compressor 15, air which has been compressed via the adapter 6 can be pressed into the anchor bolt 2, which upon expansion routes the remaining, unwanted fluid portion out of the anchor bolt 2 into the expansion line 7. The pressurized gas, especially compressed air, can be introduced within the framework of the invention before and/or after supply of fluid to the anchor 1.

To introduce especially compressed air after expanding the anchor bolt 2, in particular after expanding the anchor bolt 2 the holding pressure, i.e. the fluid pressure, is held via the holding pressure line 8 for compressing the gaskets 10 and the inflation pressure, i.e. the fluid working pressure of preferably 240 to 300 bar, is reduced. At this instant in the process the valve 13 in the expansion line 7 is opened and the valve 16 in the gas line 14 is closed.

When the fluid has flowed/been expelled for the most part out of the anchor bolt 2, in the next step the valve 13 is closed and the valve 16 is opened so that gas, especially air, is routed via the gas line 14 and the expansion line 7 into the adapter 6, and thus into the anchor bolt 2. The holding pressure is maintained at this instant.

Subsequently, the valve 16 is closed again and the valve 13 is opened so that the gas which has been pressed into the anchor bolt 2 emerges via the expansion line 7 and in doing so presses the remaining fluid out of the anchor bolt 2.

The described processes can optionally be repeated until the fluid (for example water) is completely removed. To remove the adapter 6 from the sleeve 3, the holding pressure is lowered.

Analogously to the existing details, especially in the described valve positions with gas and fluid supply to the anchor bolt 2, in the invention it is also possible for especially compressed air to be introduced before expanding the anchor bolt 2 into the initially still empty anchor 1 which has been inserted into the bore hole.

Then the anchor 1 is supplied with the expanding fluid and is expanded by pressure. The profile deploys and the anchor 1 adjoins the bore hole wall with the formation of a frictional and positive connection. During this process the air which was injected previously is compressed. After expanding the anchor bolt 2 the adapter 6 is removed. The compressed air is relieved (pressure equalization) and routs the fluid located in the anchor bolt 2 out of the anchor 1.

In contrast to methods in which the air volume which is under normal air pressure in the anchor 1 is compressed, at the arbitrarily produced overpressure before supply with fluid, after pressure equalization much less residual water remains in the anchor 1. The interior of the anchor 1 is then almost dry.

The fluid emerging from the anchor bolt 2 can be routed from the pump 9 into a tank either via the drain line 18 or directly into a closed circuit.

In summary, one embodiment for setting a rock anchor 1 using the device of the invention and the process of the invention can be described as follows:

After a rock anchor 1 which encompasses the anchor bolt 2, especially an expandable friction tube anchor 1, has been inserted with an end sleeve 4 beforehand into a bore hole produced previously, on the sleeve 3 there is an adapter 6 with liquid supply and drain. On the one hand, via the holding pressure line 8 a holding pressure is produced which fixes the adapter 6 on the sleeve 3. On the other hand, via the expansion line 7 fluid flows into the anchor bolt 2 and begins to fill it. In this connection, the anchor bolt 2 is expanded as a result of the pressure increase (inflation pressure) in the bore hole, so that its outer surface adjoins the bore hole wall and fixes the rock anchor 1 in the bore hole in this way.

Via a gas supply which is connected to the adapter 6, a pressurized gas, especially compressed air, before and/or after expanding the anchor bolt 2, can be introduced into the latter. The compressed gas is relieved after removing the adapter 6 (pressure equalization) and routs the fluid located in the anchor bolt 2 almost completely out of the anchor 1.

The invention claimed is:

1. A device for expanding and evacuating an expandable part (2) of a rock anchor (1), the device comprising:

an anchor plate; and an adapter (6) removably attachable to the anchor (1), wherein the adapter is connected both, via at least one fluid line (7, 8), to a pump (9) and also to the expandable part (2), the pump connected to a fluid source providing fluid for expanding the expandable part (2) by fluid-filling the expandable part (2), and wherein the adapter is further connected to a gas supply, the gas supply arranged for evacuating the fluid-filled expandable part (2) in a controlled manner by emerging the pressurized gas into the fluid-filled part (2) and pressurized gas routing the fluid out of the expandable part (2).

2. The device as claimed in claim 1, wherein, the expandable part (2) of the anchor has an opening (5) into an interior of the expandable part (2), the adapter (6) further comprises i) a supply hole (11) configured to defined a fluid flow through the opening (5) of the anchor into the interior of the expandable part (2), the at least one fluid line comprises i) a pressure line (8) connected to the adapter to provide a fluid to seal the adapter to the anchor, the at least one fluid line further comprises ii) an expansion line (7) connected to the supply hole (11) of the adapter (6) to provide the fluid flow through the supply hole (11) into the opening (5) of the anchor and into the interior of the expandable part (2), the fluid flow creating a working pressure sufficient to expand the expandable part (2), a gas supply line (14) connected to the adapter to provide gas to evacuate fluid from the interior of the expandable part (2) out of the anchor (1), and the adapter is configured to be removed from the anchor bolt after evacuating the fluid from the interior of the expandable part (2) out of the anchor (1).

3. The device as claimed in claim 2, wherein, the gas is pressurized air, and further comprising a compressor (15) connected to the gas supply line to provide the pressurized air to the adapter to evacuate the fluid from the interior of the expandable part (2) out of the anchor (1) through an expansion line (7).

4. The device as claimed in claim 3, wherein the compressor (15) is one of i) a gas compressor and ii) a compressed air tank.

5. The device as claimed in claim 2, further comprising:

an expansion line valve (13) in the expansion line (7); and a gas supply line valve (16) in the gas supply line (14).

6. The device as claimed in claim 5, further comprising:

a control unit (17), wherein the expansion line valve (13) and gas supply line valve (16) are controlled by the control unit (17).

7. The device as claimed in claim 5, wherein the gas supply line (14) discharges the gas into the expansion line (7) in a region between the expansion line valve (13) and the adapter (6).

8. The device as claimed in claim 2, wherein, the pressure line (8) and the expansion line (7) are connected between the pump and the adapter so that the expansion line provides the fluid to seal the adapter to the anchor and the expansion line (7) provides the pressurized fluid at the working pressure to expand the expandable part.

9. The device as claimed in claim 2, wherein the adapter further comprises gaskets (10), under pressure from the fluid provided by the pressure line, to seal the adapter against the anchor and define a sealed space between the gaskets with the opening (5) located within the sealed space.

10. The device as claimed in claim 2, wherein the adapter further comprises a gasket (10) configured to seal against the anchor under pressure from the fluid provide by the pressure line.

11. The device as claimed in claim 1, wherein, the expandable part (2) of the anchor has an opening (5) into an interior of the expandable part (2), the adapter (6) comprises i) gaskets (10) configured to seal against the anchor and define a sealed space between the gaskets, the opening (5) being located with the sealed space, ii) a supply hole (11) configured to defined a fluid flow through the supply hole (11), into the sealed space, and into the opening (5) of the anchor, and then into the interior of the expandable part (2), the at least one fluid line (7, 8) comprises plural fluid lines (7, 8) connecting the adapter to the pump (9), a first of the fluid lines being an pressure line (8) connected to the adapter to provide the fluid within the adapter to press the gaskets against the anchor and thereby define the sealed space, a second of the fluid lines being an expansion line (7) connected to the supply hole (11) of the adapter (6) to provide the fluid flow through the supply hole (11), into the sealed space, and into the opening (5) of the anchor, and then into the interior of the expandable part (2), a control unit (17) is connected to control the pump so that the fluid flow from the expansion line (7) into the interior of the expandable part (2) to create a working pressure sufficient to expand the expandable part (2), a gas supply line (14) is connected to the adapter to provide gas to evacuate fluid from the interior of the expandable part (2) out of the anchor (1) through the expansion line (7), and the adapter is configured to be removed from the anchor bolt after evacuating the fluid from the interior of the expandable part (2) out of the anchor (1).

12. A process for evacuation of fluid-filled parts of a rock anchor, comprising the steps of:

supplying a pressurized gas to an adapter removably sealed with the anchor; and in a controlled manner, evacuating fluid from the fluid-filled parts of the anchor by emerging the pressurized gas into the fluid-filled parts of the anchor.

13. A process as claimed in claim 12, comprising the further step of, during the supplying and evacuating steps, maintaining a holding pressure on the adapter (6) to seal the adapter (6) to the anchor.

14. A process as claimed in claim 13, wherein the holding pressure is lowered to remove the adapter (6).

15. A process as claimed in claim 12, wherein the supplying step further comprises closing an expansion line valve (13) in an expansion line (7) and opening a gas supply valve (16) in an gas supply line (14).

16. A process as claimed in claim 12, wherein after the supplying step, a gas supply line valve (16) in the gas supply line (14) is closed and an expansion line valve (13) in the expansion line (7) is opened.

17. A process as claimed in claim 12, wherein the fluid evacuated is routed in a closed circuit.

18. A process as claimed in claim 12, wherein the pressurized gas is supplied to the parts (2) to be evacuated before and after expanding the parts (2).

19. A process as claimed in claim 12, wherein the pressurized gas in the parts (2) is relieved by pressure equalization and the fluid is routed out of the parts (2) to be evacuated.

20. A process for setting rock anchors, comprising:

after an anchor has been positioned in a rock bore hole and with an adapter sealed to the anchor, filling and expanding expandable parts (2) of the anchor by introducing a fluid into the expandable part, the fluid applying internal pressures to the expandable parts, wherein the expandable parts expand to set the anchor in the bore hole; and in a controlled manner, evacuating the fluid-filled expandable parts of the anchor by emerging the pressurized gas into the fluid-filled parts of the anchor, wherein the fluid is routed with the pressurized gas out of the expandable parts (2); and removing the adapter from the anchor, wherein the anchor remains set in the bore hole.

* * * * *